US011639569B2

(12) United States Patent
Sato

(10) Patent No.: US 11,639,569 B2
(45) Date of Patent: May 2, 2023

(54) SEWING MACHINE

(71) Applicant: SUZUKI MANUFACTURING, LTD., Yamagata (JP)

(72) Inventor: Mitsuru Sato, Yamagata (JP)

(73) Assignee: SUZUKI MANUFACTURING, LTD., Yamagata (JP)

( * ) Notice: Subject to any disclaimer, the term of this patent is extended or adjusted under 35 U.S.C. 154(b) by 150 days.

(21) Appl. No.: 17/289,061

(22) PCT Filed: Jul. 23, 2019

(86) PCT No.: PCT/JP2019/028813
§ 371 (c)(1),
(2) Date: Apr. 27, 2021

(87) PCT Pub. No.: WO2020/166107
PCT Pub. Date: Aug. 20, 2020

(65) Prior Publication Data

US 2021/0404100 A1 Dec. 30, 2021

(30) Foreign Application Priority Data

Feb. 15, 2019 (JP) ..... JP2019-025031

(51) Int. Cl.
*D05B 27/04* (2006.01)
*D05B 27/08* (2006.01)

(52) U.S. Cl.
CPC ..... *D05B 27/04* (2013.01); *D05B 27/08* (2013.01)

(58) Field of Classification Search
CPC ..... D05B 27/02; D05B 27/04; D05B 27/06; D05B 27/08
See application file for complete search history.

(56) References Cited

U.S. PATENT DOCUMENTS 4,589,364 A * 5/1986 Yamamoto ..... D05B 27/04 112/311
4,624,202 A * 11/1986 Alberti ..... D05B 27/08 112/323

(Continued)

FOREIGN PATENT DOCUMENTS

CN 112166214 B 11/2021
JP Y1953006143 Y 7/1953

(Continued)

OTHER PUBLICATIONS

First Office Action dated Aug. 1, 2022 issued in corresponding Chinese Patent Appln. No. 201980083497.9 with an English Mechanical translation.

(Continued)

*Primary Examiner* — Nathan E Durham
(74) *Attorney, Agent, or Firm* — Bacon & Thomas, PLLC

(57) ABSTRACT

Provided is a sewing machine capable of positioning feed dogs with a sufficient distance below the upper surface of a throat plate when the feed dogs are retracted. Feed dogs 3 protrude and retract from a throat plate 1. A horizontal feed drive unit 8 converts the rotation of a drive shaft 7 into a reciprocating motion in the horizontal direction and transmits the horizontal reciprocating motion to the feed dogs 3. A vertical drive unit 9 converts the rotation of the drive shaft 7 into a reciprocating motion in the vertical direction and transmits the vertical reciprocating motion to the feed dogs 3. A vertical position changing part moves turn-back points P at both ends of a forward path and a return path when the feed dogs 3 reciprocate in the horizontal direction below the throat plate 1.

2 Claims, 8 Drawing Sheets

(56) References Cited

U.S. PATENT DOCUMENTS

| | | | | | |
|---|---|---|---|---|---|
| 4,958,580 | A * | 9/1990 | Asaba | D05B 27/02 | 112/323 |
| 5,103,751 | A * | 4/1992 | Wang | D05B 27/08 | 112/314 |
| 5,337,689 | A * | 8/1994 | Tilders | D05B 27/08 | 112/323 |
| 5,738,028 | A * | 4/1998 | Wang | D05B 27/08 | 112/313 |
| 2017/0121878 | A1 * | 5/2017 | Koike | D05B 27/08 | |

FOREIGN PATENT DOCUMENTS

| | | | |
|---|---|---|---|
| JP | U1986047988 | U | 3/1986 |
| JP | U11988163772 | U | 10/1988 |
| JP | Y1989035729 | Y | 10/1989 |
| JP | H0422395 | A | 1/1992 |
| JP | H04164485 | A | 6/1992 |
| JP | H10127967 | A | 5/1998 |
| JP | 2017080291 | A | 5/2017 |
| JP | 2017148470 | A | 8/2017 |

OTHER PUBLICATIONS

International Search Report in corresponding PCT Appln. No. PCT/JP2019/028813.

* cited by examiner

SEWING MACHINE

TECHNICAL FIELD

The present invention relates to a sewing machine used for sewing products made of cloth.

BACKGROUND ART

This type of sewing machine has feed dogs for feeding cloth on a throat plate pressed by a presser foot. The feed dogs elliptically move by reciprocating in a horizontal direction in a cloth feed direction and in a vertical direction with respect to the upper surface of the throat plate in a sewing process.

More specifically, the feed dogs repeat a process in which the feed dogs advance forward in the cloth feed direction when the feed dogs move above the throat plate, retract at a position below the throat plate, and move above the throat plate again. In this case, the forward feed of the cloth by the feed dogs is performed when a needle is in the vicinity of a top dead center position. Therefore, the feed dogs are operated synchronously so as to protrude from the upper surface of the throat plate when the needle is raised.

Meanwhile, before a sewing operation is started, the presser foot is raised and cloth is set at an initial position of the sewing operation. At this time, the needle is at the raised position, so that the feed dogs are in a state of protruding from the upper surface of the throat plate. If the cloth is positioned below the needle in this state, the cloth comes in contact with the feed dogs protruding from the upper surface of the throat plate, leading to a possibility of interfering with smooth preparation for the sewing operation.

Thus, there has been proposed a feed dog lowering mechanism (refer to, for example, Patent Literature 1 given below) adapted to lower the feed dogs from the upper surface of the throat plate when the presser foot is raised before the sewing operation is begun.

The feed dog lowering mechanism disclosed in Patent Literature 1 has an eccentric cam provided on a drive shaft, a lifting and lowering link connected, through a square piece, to a rod extending from the eccentric cam, and a guide member equipped with a guide groove that guides the square piece, and is configured to interlock the rotation of the guide member with a presser operation lever that separates the presser foot above the throat plate.

According to the configuration, when the presser foot is raised by operating the presser operation lever, the guide member rotates and the guide groove, which guides the square piece, tilts. The square piece moves along the tilted guide groove, thereby enabling the feed dogs to move to a position below the upper surface of the throat plate (a retracted position). Thus, the feed dog lowering mechanism disclosed in Patent Literature 1 can retract the feed dogs by the simple configuration.

CITATION LIST

Patent Literature

Patent Literature 1: Japanese Examined Utility Model Application Publication No. 1-35729

SUMMARY OF INVENTION

Technical Problem

Meanwhile, feed dogs preferably move a sufficient distance in the state of protruding from the upper surface of a throat plate when moving forward to feed cloth. On the other hand, when the feed dogs switch from forward movement to backward movement, if the feed dogs are positioned above the upper surface of the throat plate even for a short period of time, there is a possibility that the retracting feed dogs will interfere with the forward feed of the cloth. For this reason, the positions of the turn-back points at both ends of a forward path and a return path for the feed dogs to reciprocate in a horizontal direction are set to be slightly below the upper surface of the throat plate.

However, if the feed dog lowering mechanism disclosed in the aforesaid Patent Literature 1 is adopted, there is a possibility that the feed dogs in a retracted state are inconveniently positioned above the upper surface of the throat plate due to a setting error of the amount of protrusion of the feed dogs from the upper surface of the throat plate, the dimensional errors of components, or the like.

To prevent the problem described above, if the positions of the turn-back points of the feed dogs are set below the upper surface of the throat plate with a relatively large distance, then the amount of protrusion of the feed dogs from the upper surface of the throat plate will be small, leading to a possibility that cloth cannot be sufficiently fed.

In view of the above, an object of the present invention is to provide a sewing machine capable of reliably feeding cloth by feed dogs during a sewing operation and positioning the feed dogs sufficiently below the upper surface of a throat plate when the feed dogs are retracted.

Solution to Problem

To this end, a sewing machine in accordance with the present invention includes: feed dogs which protrude and retract from an upper surface of a throat plate; a presser foot which faces the top of the feed dogs; a drive shaft which transmits the power of a drive source; a horizontal feed drive unit which converts a rotation of the drive shaft into a reciprocating motion in a horizontal direction and transmits the reciprocating motion in the horizontal direction to the feed dogs; a vertical drive unit which converts a rotation of the drive shaft into a reciprocating motion in a vertical direction and transmits the reciprocating motion in a vertical direction to the feed dogs; a vertical travel distance changing part which changes a reciprocating travel distance of the feed dogs in the vertical direction; and a vertical position changing part which moves turn-back points at both ends of a forward path and a return path at the time of horizontal reciprocating travel of the feed dogs to be below the upper surface of the throat plate in the case where the vertical travel distance changing part decreases a vertical travel distance of the feed dogs.

The sewing machine according to the present invention is provided with the vertical position changing part, thus making it possible to move the turn-back points at both ends of the forward path and the return path at the time of the horizontal reciprocating travel of the feed dogs to be below the upper surface of the throat plate. With this arrangement, when the feed dogs are retracted, the turn-back points can be positioned sufficiently below the upper surface of the throat plate by the vertical position changing part.

Further, in the sewing machine according to the present invention, the vertical drive unit includes: an eccentric cam which is rotated by the drive shaft; an advancing and retreating arm which is moved forward and backward in the horizontal direction by the eccentric cam; a lifting and lowering link which has a lower end thereof connected to the advancing and retreating arm through a lower connecting shaft and an upper end thereof connected to a feed base which supports the feed dogs through an upper connecting shaft such that the feed dogs can move in the horizontal direction; a square piece provided coaxially with the lower connecting shaft of the lifting and lowering link; a guide member having a guide groove formed therein to linearly guide the square piece; and a rotating shaft which rotatably supports the guide member, the vertical travel distance changing part includes a guide member rotating mechanism which rotates the guide member to change a tilt angle of the guide groove, thereby changing the travel distance of the feed dogs in a state of protrusion from the throat plate, the vertical position changing part is configured by placement in which the rotating shaft of the guide member and the center of a reciprocating travel region of the square piece in the guide groove are shifted away from each other, and the center of the reciprocating travel region of the square piece is positioned, being shifted to be lower than the rotating shaft of the guide member when the guide member is rotated by the guide member rotating mechanism to cause the guide groove to tilt.

According to the vertical drive unit having the aforesaid configuration, the rotation of the drive shaft is converted through the eccentric cam into the horizontal advancing and retreating motion of the advancing and retreating arm. The advancing and retreating motion of the advancing and retreating arm causes the square piece to reciprocate along the guide groove of the guide member. The lower end of the lifting and lowering link is connected to the square piece through the lower connecting shaft, and the upper end of the lifting and lowering link is connected to the feed base through the upper connecting shaft. With this arrangement, the lifting and lowering link swings when the square piece reciprocates along the guide groove, and the feed base is moved up and down by the swing of the lifting and lowering link.

Regarding the relationship between the inclination of the guide groove and the vertical motion of the feed dogs, the feed dogs move up and down the most when, for example, the guide groove is horizontal. As the guide groove gradually tilts down in the advancing direction of the advancing and retreating arm, the vertical motion of the feed dogs becomes smaller while the horizontal travel distance thereof remains unchanged. In other words, when a tilt is imparted so that the guide groove is tilted down in the advancing direction of the advancing and retreating arm by rotating the guide member, the feed dogs do not move up and down even when the drive shaft rotates (perform only the horizontal reciprocating motion).

At this time, in the vertical position changing part, the rotating shaft of the guide member and the center of the reciprocating travel region of the square piece in the guide groove are positioned so as to be shifted away from each other. This shift causes the center of the reciprocating travel region of the square piece to be positioned lower than the rotating shaft of the guide member when the guide groove is in a tilted state. With this arrangement, when the guide groove is tilted, the feed dogs can be reliably retracted below the upper surface of the throat plate by lowering the turn-back points of the feed dogs.

DESCRIPTION OF EMBODIMENTS

Figure 1:
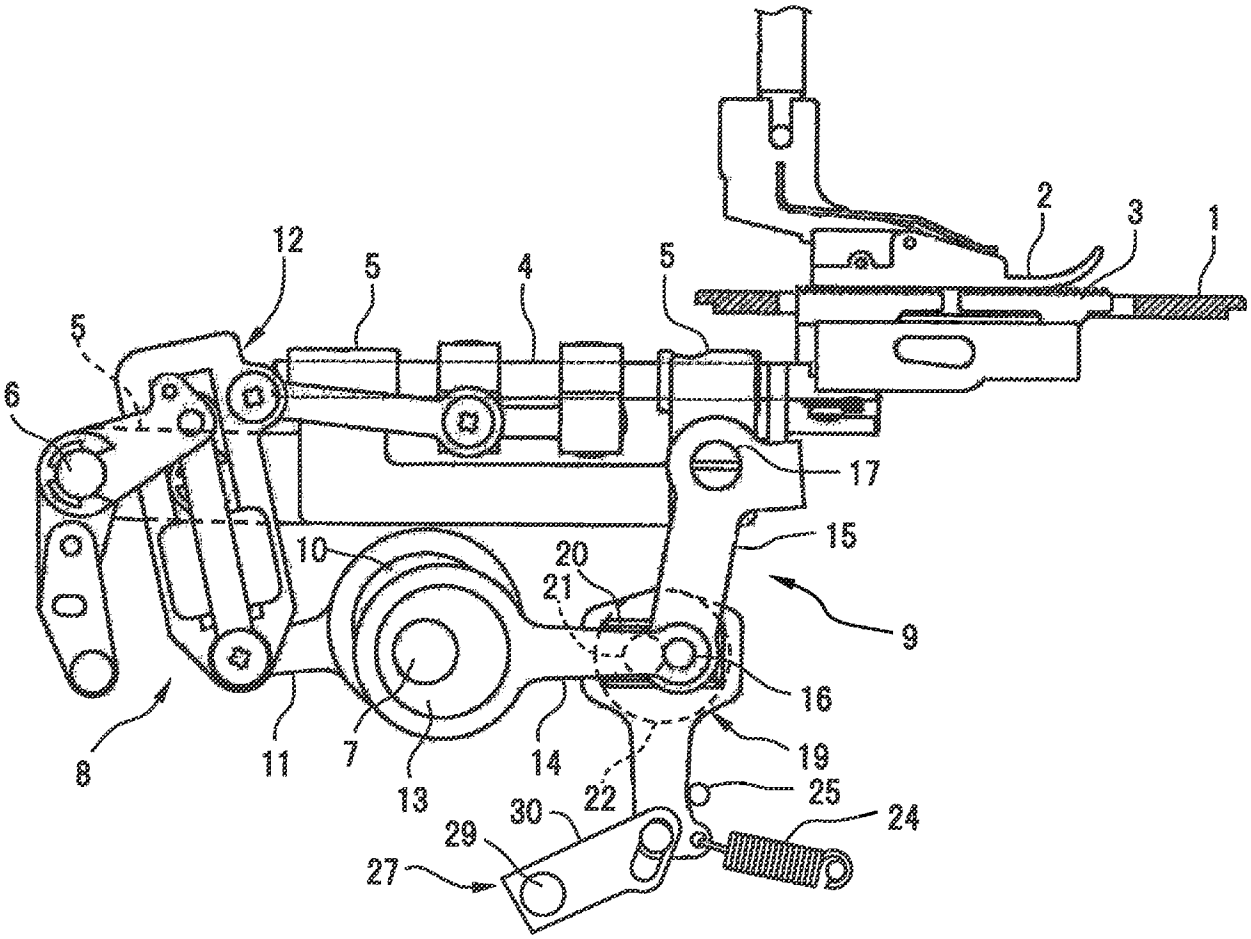
FIG. 1 is an explanatory diagram illustrating the configuration of an essential section of a sewing machine in an embodiment according to the present invention.

An embodiment of the present invention will be described with reference to the accompanying drawings. Although the illustration of the overall configuration is omitted, a sewing machine of the present embodiment is provided with a sewing needle (not illustrated) which vertically reciprocates, a throat plate 1 on which the cloth of clothing or the like is placed, a presser foot 2 which presses the cloth on the throat plate 1, and feed dogs 3 which protrude and retract from the upper surface of the throat plate 1 to feed the cloth, as illustrated in FIG. 1, as the configuration according to the gist of the present invention.

The feed dogs 3 are driven by a feed dog drive unit. The feed dog drive unit has a feed rod 4 extending in the horizontal direction, and a feed base 5 which supports the feed rod 4 in a longitudinally movable manner. The feed dogs 3 are integrally provided on the distal end of the feed rod 4.

The feed base 5 has the proximal end thereof connected to a frame (not illustrated) through a swing shaft 6 so as to be vertically swingable. As the feed base 5 swings, the feed dogs 3 at the distal end of the feed rod 4 move in the vertical direction. Further, the feed dog drive unit has a drive shaft 7 which transmits the power of a drive source (not illustrated), a horizontal feed drive unit 8, and a vertical drive unit 9. The drive shaft 7 is provided below the feed base 5. The drive source also drives the sewing needle.

The horizontal feed drive unit 8 has a first eccentric cam 10 which is rotated by the drive shaft 7, a first advancing and retreating arm 11 which is advanced and retreated in the horizontal direction by the first eccentric cam 10, and an advancing and retreating link 12 which transmits the advancing and retreating motion of the first advancing and retreating arm 11 to the feed rod 4. The rotation of the drive shaft 7 is converted into a horizontal feed motion by the horizontal feed drive unit 8 configured as described above and the horizontal feed motion is transmitted to the feed dogs 3.

Figure 2:
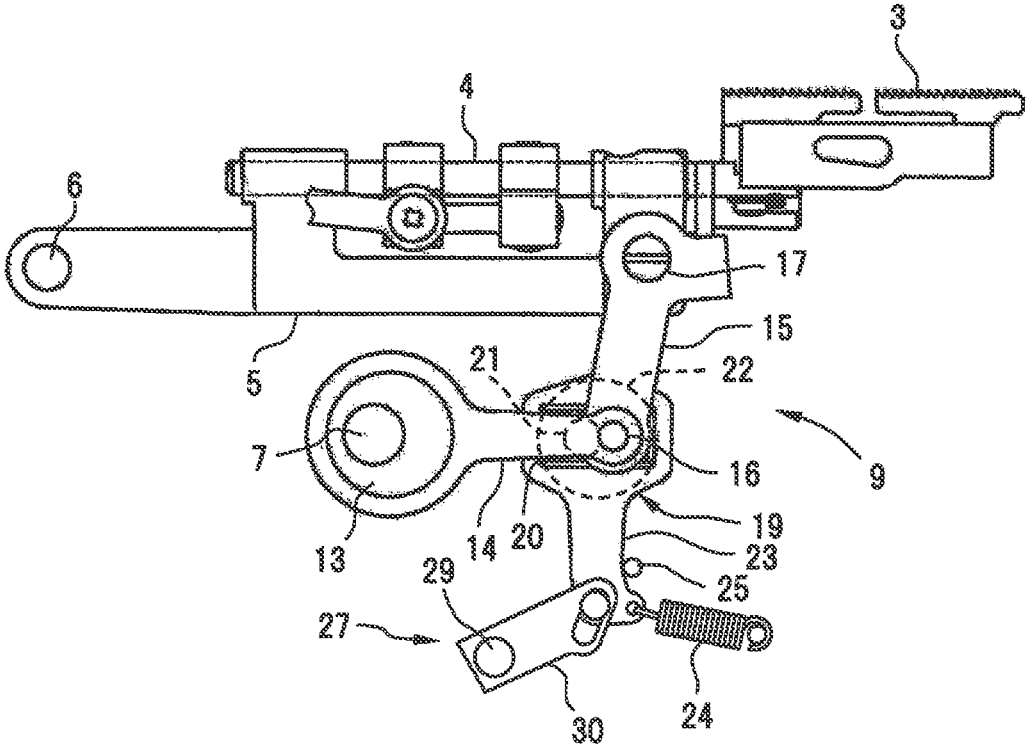
FIG. 2 is an explanatory diagram illustrating the configuration of a vertical drive unit.

The vertical drive unit 9 is adapted to convert the rotation of the drive shaft 7 into a vertical motion and transmit the vertical motion to the feed dogs 3, and includes a second eccentric cam 13, a second advancing and retreating arm 14 which is advanced and retreated in the horizontal direction by the second eccentric cam 13, and a lifting and lowering link 15 connected to the second advancing and retreating arm 14, as illustrated in FIG. 1 and FIG. 2. The second eccentric cam 13 corresponds to the eccentric cam in the present invention, and the second advancing and retreating arm 14 corresponds to the advancing and retreating arm in the present invention.

The lifting and lowering link 15 has the lower end thereof connected to the second advancing and retreating arm 14 through a lower connecting shaft 16, and the upper end thereof connected to the feed base 5 through an upper connecting shaft 17, as illustrated in FIG. 2. A square piece 18 is provided at the lower end portion of the lifting and lowering link 15 so as to be coaxial with the lower connecting shaft 16.

The square piece 18 is slidably accommodated in a guide groove 20 formed in a guide member 19. The guide member 19 is disposed on one side (the right side in FIG. 2) of the drive shaft 7 and directly under the feed base 5. Because of the position where the guide member 19 is disposed, the lifting and lowering link 15 is connected between the swing shaft 6 in the feed base 5 and the feed dogs 3. This enables the vertical motion of the lifting and lowering link 15 to be smaller than in the case where the leading end of the feed dogs 3 is lifted and lowered.

Figure 3:
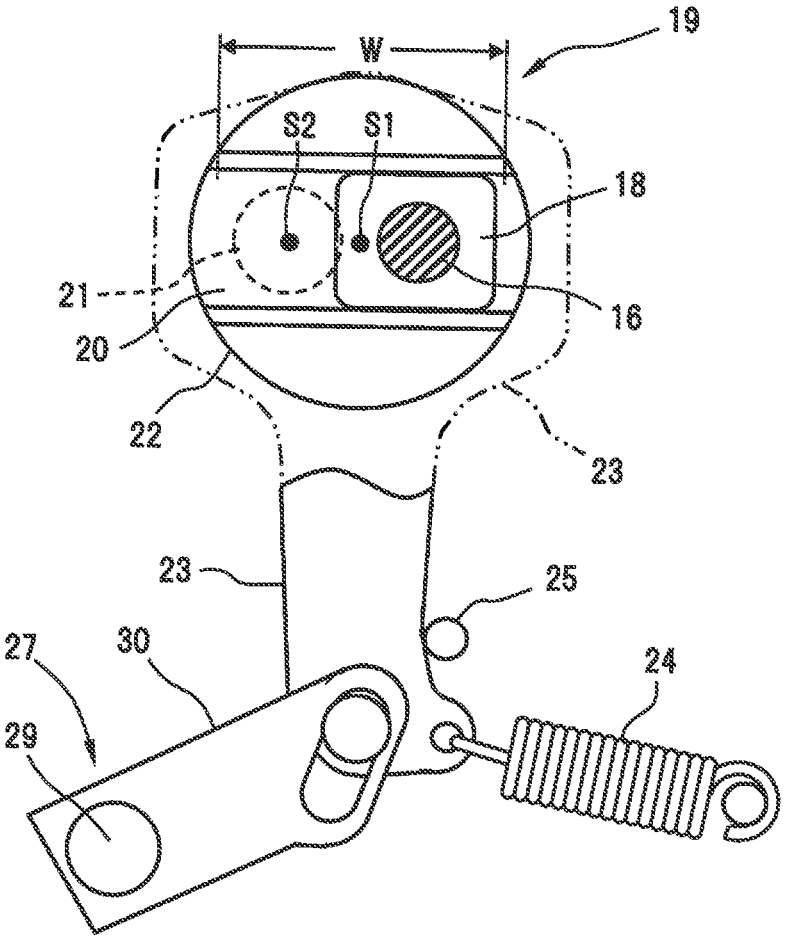
FIG. 3 is an explanatory diagram illustrating the configuration of a guide member.

As illustrated in FIG. 3, the guide member 19 has a round body block 22 rotated by a rotating shaft 21 supported by a frame (not illustrated).

The guide groove 20 is formed on one surface of the body block 22. The body block 22 has an extended member 23 extending outward in the radial direction from one portion thereof. A return spring 24 is connected to the extended member 23. The return spring 24 is installed between the extended member 23 and a frame (not illustrated).

Further, the body block 22 is restricted, by a stopper pin 25 corning in contact with the extended member 23, in counterclockwise rotation in FIG. 3 from the position at which the guide groove 20 takes a horizontal attitude. The return spring 24 urges the body block 22 in a return direction (the counterclockwise direction) when the body block 22 rotates in the clockwise direction in FIG. 3.

The simple configuration of the guide member 19 enables the guide member 19 to be installed without any problem even in a relatively narrow space such as directly under the feed base 5. Consequently, a vertical drive unit 9 has a compact configuration.

In addition, the rotating shaft 21 is provided such that the center thereof is eccentric with respect to the center of the round body block 22. The relationship among the eccentric rotating shaft 21, the tilt of the guide groove 20 caused by the rotation of the guide member 19, and the reciprocating travel region of the square piece 18 creates the configuration for obtaining the function as the vertical position changing part in the present invention. This configuration will be described in detail later.

Figure 4:
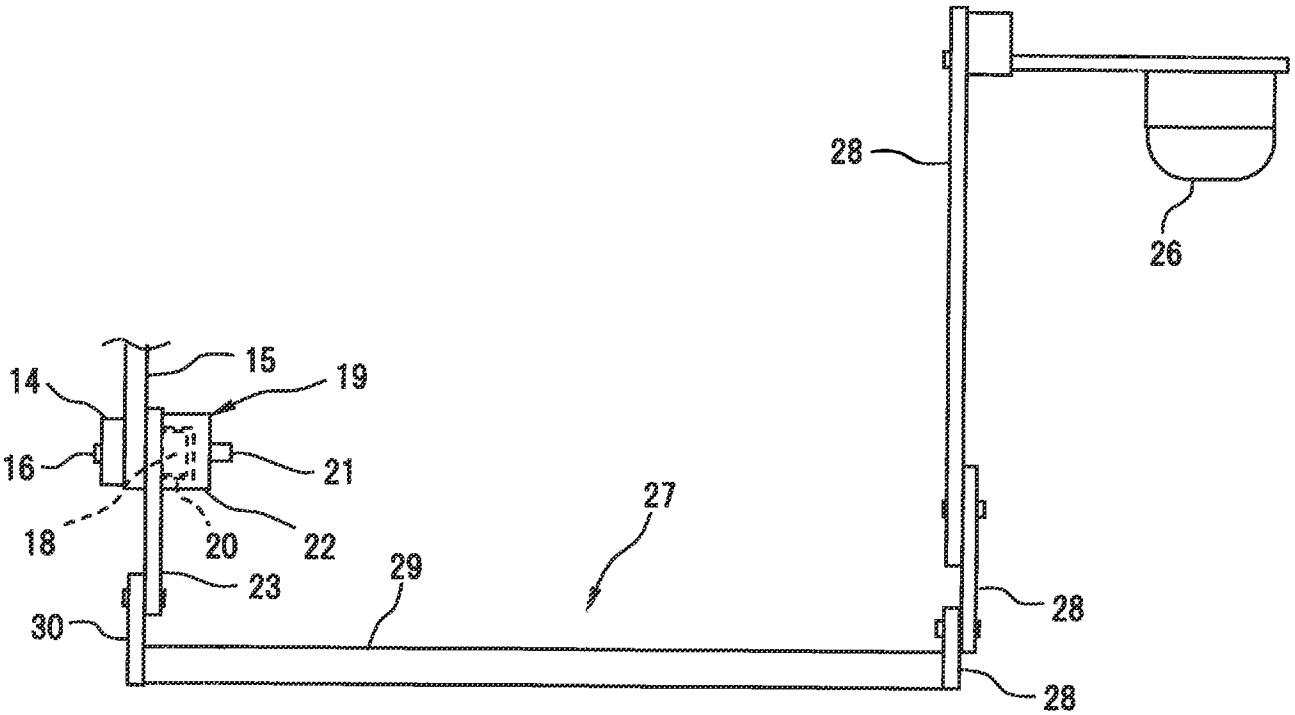
FIG. 4 is an explanatory diagram illustrating the configuration of an essential section of a guide member rotating mechanism.

As illustrated in FIG. 4, the guide member 19 is rotated by operating a presser operation lever 26. The presser operation lever 26 is adapted to be raised and lowered to lift and lower the presser foot 2 (refer to FIG. 1). The presser operation lever 26 and the presser foot 2 are connected with each other through a link mechanism (not illustrated) for making the up and down movement of the presser foot 2 follow the up and down operation of the presser operation lever 26.

More specifically, in a state in which the presser operation lever 26 is down, the presser foot 2 is in a state of pressure-contact with cloth on the feed dogs 3, and in a state in which the presser operation lever 26 is up, the presser foot 2 is in a state of being separated from the cloth on the feed dogs 3.

Further, as illustrated in FIG. 4, the guide member 19 is connected to the presser operation lever 26 through a rotating link 27. The rotating link 27 has a first link part 28 which follows the up and down movement of the presser operation lever 26, a transmission shaft 29 which converts the vertical motion of the first link part 28 into rotation and transmits the rotation, and a second link part 30 which transmits the rotation of the transmission shaft 29 to the extended member 23 of the guide member 19. The rotating link 27 is the guide member rotating mechanism in the present invention and constitutes, together with the presser operation lever 26, the vertical travel distance changing part in the present invention.

When the presser operation lever 26 is positioned at the lower end of the operation range thereof, the guide groove 20 of the guide member 19 is set to be horizontal (or substantially horizontal) by the first link part 28, the transmission shaft 29, and the second link part 30. Further, a function of the vertical travel distance changing part makes it possible to adjust the tilt angle of the guide groove 20 of the guide member 19 according to the operation angle of the presser operation lever 26.

Figure 5:
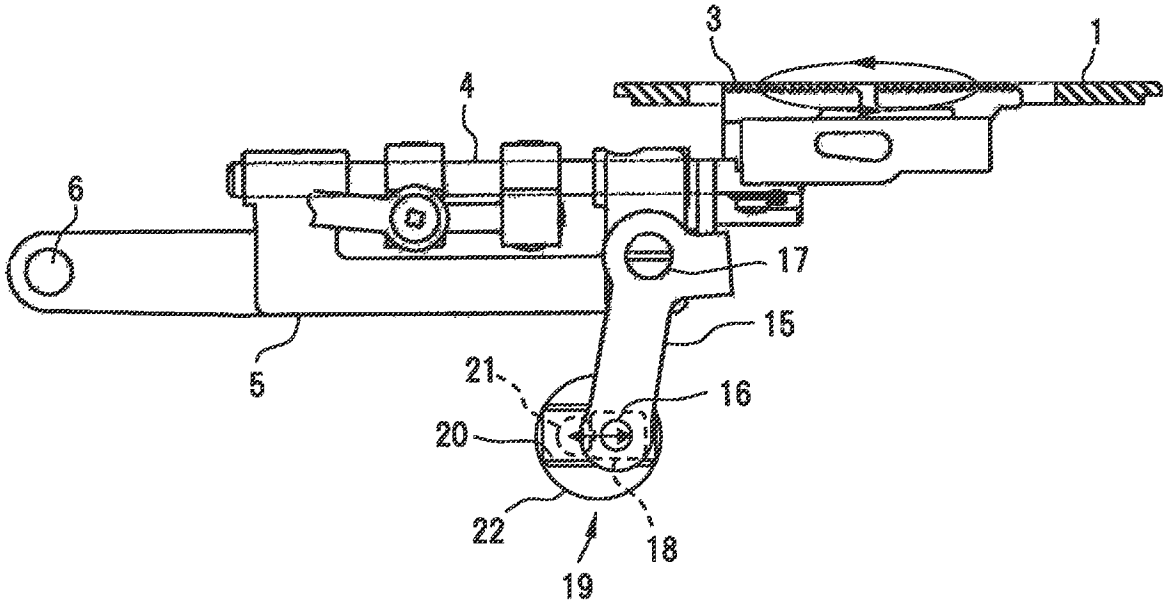
FIG. 5 is an explanatory diagram illustrating a state of an essential section during a sewing operation.

As illustrated in FIG. 5, when the guide groove 20 of the guide member 19 is horizontal, the direction in which the square piece 18 reciprocates becomes the horizontal direction along the guide groove 20, so that the feed base 5 is lifted up and pulled down by the lifting and lowering link 15 as the square piece 18 reciprocates. Consequently, the vertical travel distance of the feed dogs 3 reaches a maximum and the feed dogs 3 move, drawing an elliptical trajectory, to feed the cloth by the advancing motion when protruding upward above the upper surface of the throat plate 1.

When the presser operation lever 26 is raised, the first link part 28 moves along the longitudinal direction thereof, and the second link part 30 rotates the guide member 19 against the biasing of the return spring 24 as the transmission shaft 29 rotates. This causes the guide groove 20 of the guide member 19 to tilt. The tilt of the guide groove 20 at this time will be a tilt that causes gradual movement down in a direction in which the second advancing and retreating arm 14 pushes out (rightward in the drawing).

Figure 6:
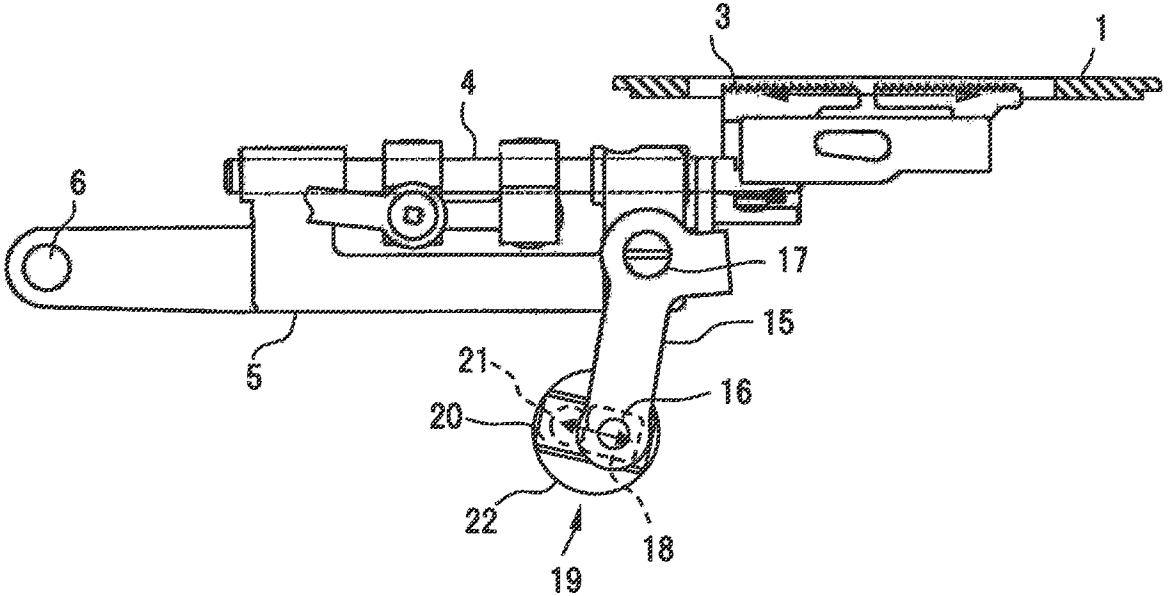
FIG. 6 is an explanatory diagram illustrating the state of the essential section at the time of retraction.

As illustrated in FIG. 6, when the guide groove 20 of the guide member 19 tilts, the upper end of the lifting and lowering link 15 does not vertically move even when the square piece 18 reciprocates along the guide groove 20 in the tilted state. Consequently, the feed dogs 3 operate, drawing a linear trajectory in the horizontal direction, without a vertical motion. At this time, the feed dogs 3 are positioned below the upper surface of the throat plate 1, so that the feed dogs 3 do not interfere with the setting of cloth above the feed dogs 3 to prepare for a sewing operation.

Further, as described above, the rotating shaft 21 is provided such that the center thereof is eccentric with respect to the center of the round body block 22, thus making it possible to reliably retract the feed dogs 3 below the upper surface of the throat plate 1.

This will be described in detail by comparison with a case where the center of the rotating shaft 21 is not eccentric with respect to the center of the body block 22.

Figure 7:
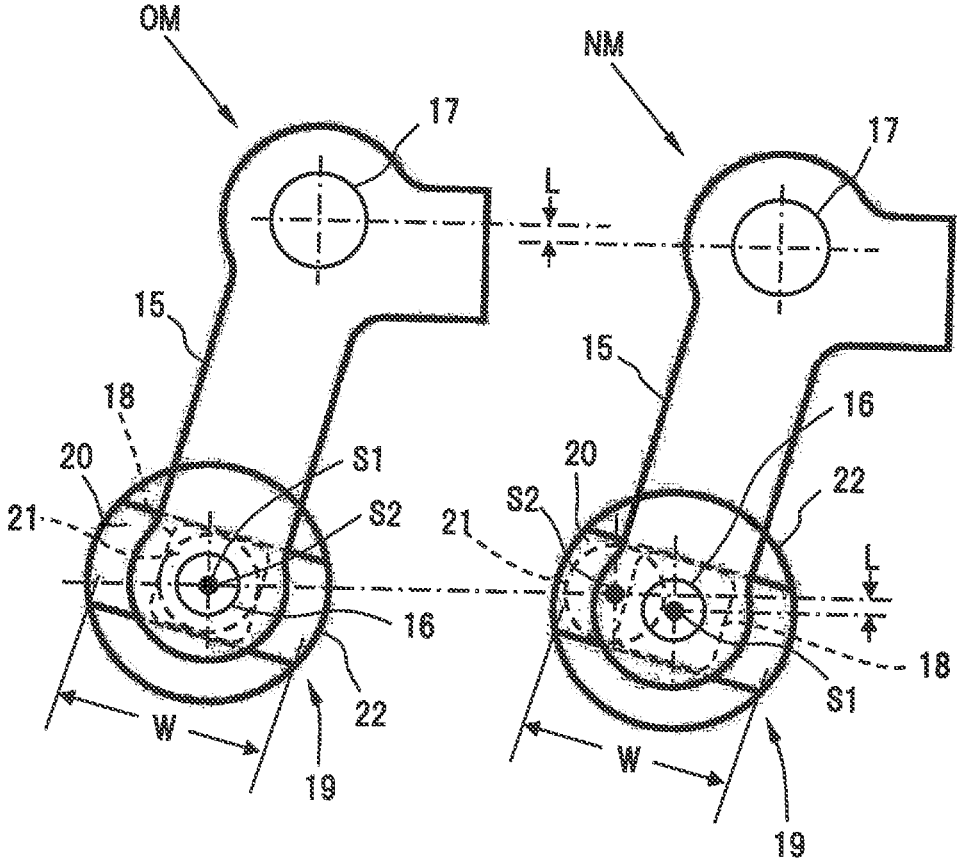
FIG. 7 is an explanatory diagram illustrating the comparison in configuration between a rotating shaft in the guide member with eccentricity and the same without eccentricity.

In FIG. 7, a configuration OM without eccentricity is illustrated as a reference example on the left side in the drawing, and a configuration NM with eccentricity, which is the present embodiment, is illustrated on the right side in the drawing.

The square piece 18 reciprocates along the guide groove 20. At this time, the longitudinal dimension of the guide groove 20 can be reduced by making the longitudinal center of the guide groove 20 and a center S1 of a reciprocating travel region W of the square piece 18 coincide with each other, and the body block 22 can be consequently made compact. Further, in this case, the center of the body block 22 and the longitudinal center of the guide groove 20 coincide with each other.

As illustrated in FIG. 7, in the configuration NM of the present embodiment, the center of the rotating shaft 21 is set eccentric with respect to the center of the body block 22, thereby causing the center S1 of the reciprocating travel region W of the square piece 18 to be shifted to the lowering side of the guide groove 20 so as to tilt farther than a center S2 of the rotating shaft 21.

Figure 8:
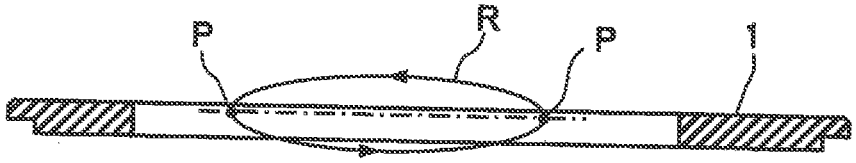
FIG. 8 is an explanatory diagram illustrating a positional relationship between the trajectory of feed dogs and a throat plate during the sewing operation.

In the state in which the cloth is fed during a sewing operation, the feed dogs 3 move on the elliptical trajectory, moving above the upper surface of the throat plate 1 to feed the cloth and moving below the upper surface of the throat plate 1 to go back to the return position thereof. At this time, the feed dogs 3 move, drawing an elliptical trajectory R with respect to the throat plate 1 as indicated by the relationship between the trajectory of the feed dogs 3 and the throat plate 1 in FIG. 8.

Further, the turn-back points P at both ends of the forward path and the return path of the reciprocating travel of the feed dogs 3 in the horizontal direction are set to be very slightly below the upper surface of the throat plate 1. The trajectory of the feed dogs 3 in the retracted state becomes a linear trajectory that connects both turn-back points P. In the configuration OM without eccentricity illustrated as a reference example in FIG. 7, the center S1 of the reciprocating travel region W of the square piece 18 and the center S2 of the rotating shaft 21 coincide with each other, so that the positions of the turn-back points P of the feed dogs 3 during a sewing operation (a state in which cloth feed is being performed) and the turn-back points P of the feed dogs 3 in the retracted state due to the tilt of the guide groove 20 do not change.

Figure 9:
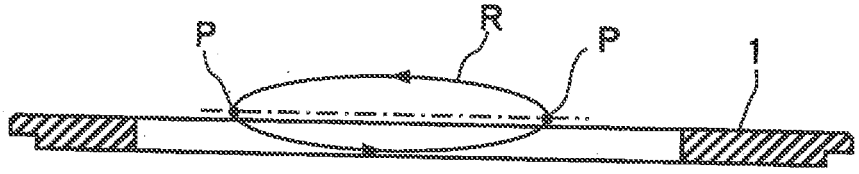
FIG. 9 is an explanatory diagram illustrating another positional relationship between the trajectory of the feed dogs and the throat plate during the sewing operation.

Here; if it is assumed that the turn-back points P of the feed dogs 3 are undesirably positioned slightly above the upper surface of the throat plate 1 as illustrated in FIG. 9 due to an error of the height adjustment of the feed dogs 3 or a dimensional error of a component, then the feed dogs 3 will protrude above the upper surface of the throat plate 1 even when the feed dogs 3 are in the retracted state, preventing smooth setting of cloth under a sewing needle in the case of the configuration OM without eccentricity illustrated in FIG. 7.

In contrast, according to the configuration NM with eccentricity of the present embodiment illustrated in FIG. 7, the center S1 of the reciprocating travel region W of the square piece 18 is shifted to the lowering side of the tilted guide groove 20 with respect to the center S2 of the rotating shaft 21, thus generating a lowering allowance L (exaggerated for convenience of explanation) between the lower connecting shaft 16 and the upper connecting shaft 17 of the lifting and lowering link 15.

Figure 10:
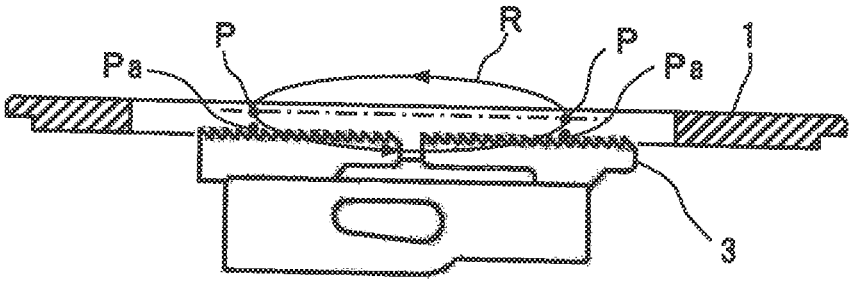
FIG. 10 is an explanatory diagram illustrating a positional relationship between the trajectory of the feed dogs during the sewing operation and the feed dogs at the time of the retraction.

Consequently, turn-back points Pa of the feed dogs 3 in the retracted state can be positioned below the turn-back points P of the feed dogs 3 during a sewing operation as illustrated in FIG. 10 simply by rotating the guide member 19 by the rotating shaft 21 with eccentricity so as to tilt the guide groove 20. Thus, cloth can be smoothly set under a sewing needle when preparing for a sewing operation or the like.

In the present embodiment, the function as the vertical position changing part in the present invention is obtained by setting the center of the rotating shaft 21 of the guide member 19 to be eccentric with respect to the center of the round body block 22 of the guide member 19. The function as the vertical position changing part can be obtained by the position of the center S1 of the reciprocating travel region W of the square piece 18 being shifted more to the lowering side than the rotating shaft 21 of the guide member 19 when the guide groove 20 tilts.

Further, the present embodiment is configured such that the guide groove 20 becomes horizontal when the presser operation lever 26 is positioned at the lower end, however, the present invention is not limited thereto. More specifically, the configuration may alternatively be such that the guide groove 20 becomes horizontal when the presser operation lever 26 is positioned at the upper end. In addition, the angle of the guide groove 20 during a sewing operation is not limited to horizontal, and can be set appropriately according to the dimensions of parts or the like.

DESCRIPTION OF REFERENCE NUMERALS

1 . . . throat plate; 2 . . . presser foot; 3 . . . feed dogs; 5 . . . feed base; 7 . . . drive shaft; 8 . . . horizontal feed drive unit; 9 . . . vertical drive unit; 13 . . . second eccentric cam (eccentric cam); 14 . . . second advancing and retreating arm (advancing and retreating arm); 15 . . . lifting and lowering link; 16 . . . lower connecting shaft; 17 . . . upper connecting shaft; 18 . . . square piece; 19 . . . guide member; 20 . . . guide groove; 21 . . . rotating shaft; 26 . . . presser operation lever (vertical travel distance changing part); 27 . . . rotating link (guide member rotating mechanism); P, Pa . . . turn-back point; W . . . reciprocating travel region; and S2 . . . center of reciprocating travel region.

The invention claimed is:

1. A sewing machine comprising: feed dogs which protrude and retract from an upper surface of a throat plate; a presser foot which faces a top of the feed dogs; a drive shaft which transmits power of a drive source; a horizontal feed drive unit which converts a rotation of the drive shaft into a reciprocating motion in a horizontal direction and transmits the reciprocating motion in the horizontal direction to the feed dogs; a vertical drive unit which converts the rotation of the drive shaft into a reciprocating motion in a vertical direction and transmits the reciprocating motion in the vertical direction to the feed dogs; a vertical travel distance changing part which changes a reciprocating travel distance of the feed dogs in the vertical direction; and a vertical position changing part which moves turn-back points at both ends of a forward path and a return path at the time of a horizontal reciprocating travel of the feed dogs to be below the upper surface of the throat plate in a case where the vertical travel distance changing part decreases a vertical travel distance of the feed dogs.

2. The sewing machine according to claim 1, wherein the vertical drive unit includes: an eccentric cam which is rotated by the drive shaft; an advancing and retreating arm which is advanced and retreated in the horizontal direction by the eccentric cam; a lifting and lowering link which has a lower end thereof connected to the advancing and retreating arm through a lower connecting shaft and an upper end thereof connected to a feed base which supports the feed dogs through an upper connecting shaft such that the feed dogs can move in the horizontal direction; a square piece provided coaxially with the lower connecting shaft of the lifting and lowering link; a guide member having a guide groove formed therein to linearly guide the square piece; and a rotating shaft which rotatably supports the guide member, the vertical travel distance changing part includes a guide member rotating mechanism which rotates the guide member to change a tilt angle of the guide groove, thereby changing the travel distance of the feed dogs in a state of protrusion from the throat plate, the vertical position changing part is configured by placement in which the rotating shaft of the guide member and a center of a reciprocating travel region of the square piece in the guide groove are shifted away from each other, and the center of the reciprocating travel region of the square piece is positioned so as to be shifted to be lower than the rotating shaft of the guide member in a case where the guide member is rotated by the guide member rotating mechanism to cause the guide groove to tilt.

* * * * *